United States Patent [19]

Tsubata

[11] Patent Number: 4,832,065

[45] Date of Patent: May 23, 1989

[54] METHOD AND APPARATUS FOR WASHING ELONGATED TAPE WITH HOT WATER

[75] Inventor: Noritaka Tsubata, Uozu, Japan

[73] Assignee: Yoshida Kogyo K. K., Tokyo, Japan

[21] Appl. No.: 188,463

[22] Filed: Apr. 29, 1988

[30] Foreign Application Priority Data

May 1, 1987 [JP] Japan ..... 62-109350

[51] Int. Cl.[4] ..... B08B 3/04

[52] U.S. Cl. ..... 134/64 R; 134/122 R; 134/198; 15/302

[58] Field of Search ..... 134/60, 64 R, 64 P, 134/122 R, 122 P, 198; 15/302

[56] References Cited

U.S. PATENT DOCUMENTS

| | | | |
|---|---|---|---|
| 1,544,506 | 6/1925 | Tytus | 134/60 |
| 2,395,397 | 2/1946 | Croft | 134/60 X |
| 2,401,185 | 5/1946 | Pratt et al. | 134/64 R X |
| 2,960,963 | 11/1960 | Snelton | 134/64 R X |
| 3,730,667 | 5/1973 | Tani et al. | 134/64 R X |
| 3,831,612 | 8/1974 | Limoges | 134/122 R |
| 3,938,214 | 2/1976 | Hodseden et al. | 134/60 X |
| 4,034,389 | 7/1977 | Huss | 134/122 P |
| 4,268,929 | 5/1981 | Sorensen et al. | 134/64 R X |
| 4,392,889 | 7/1983 | Grout | 134/64 P X |

*Primary Examiner*—Frankie L. Stinson

*Attorney, Agent, or Firm*—Hill, Van Santen, Steadman & Simpson

[57] ABSTRACT

In washing an elongated tape with hot water, the tape is fed through a succession of hot-water baths one after another. When the tape is transferred from one bath to the next, the hot water on and in the tape is removed. In each bath, the tape is brought out of and then into the hot water at least one time.

4 Claims, 2 Drawing Sheets

METHOD AND APPARATUS FOR WASHING ELONGATED TAPE WITH HOT WATER

BACKGROUND OF THE INVENTION

1. Field of the Invention

The present invention relates to a method of and apparatus for washing out foreign matter, such as oil, dust or odds and ends, on a continuous woven or knit tape.

2. Description of the Prior Art

Generally, in the manufacture of touch-and-close or so-called surface-type fasteners, a substantially endless-length fabric web or tape having a multiplicity of hook-shaped or loop-shaped (male or female) elements projecting from one surface is dyed at the finishing stage of production. A primary problem with the surface-type fastener production is that various foreign matter tends to be easily caught by the fastener elements during production, which necessitates washing and heat-setting of the tape to make it uniform in structure before dyeing. To this end, it is customary to wash the tape by drawing it through a series of hot-water baths one after another. However, this multi-bath washing is incomplete to remove foreign matter from the tape. Foreign matter on the tape can be removed by moving the tape in swinging motion during the washing; but this swinging would cause the tape to be twisted or entangled and hence to be fed in a disorderly fashion.

SUMMARY OF THE INVENTION

It is therefore an object of the present invention to provide a method of and apparatus for washing an elongated tape such as of touch-and-close or surface-type fasteners with hot water, which guarantees not only improved cleaning of the tape but also orderly feeding of the tape.

A washing method according to the present invention comprises: feeding an elongated tape through a succession of hot-water baths one after another; removing hot water from the tape and then applying hot water over the tape when the latter is transferred from one bath to the next bath; and bringing the tape out of and then into hot water in each of said baths at least one time while the tape is fed in each said bath.

A washing apparatus according to the present invention comprises: a succession of hot-water baths; a plurality of guide rollers mounted in each of said baths; and at least one driven roller disposed above each said bath for cooperation with said guide rollers therein. An elongated tape to be washed is trained on and between said guide rollers and said driven roller.

Many other objects, features and additional advantages of the present invention will become manifest to those versed in the art upon making reference to the detailed description and the accompanying sheets of drawings in which a preferred embodiment incorporating the principle of the present invention is shown by way of illustrative example.

DETAILED DESCRIPTION

Figure 1:
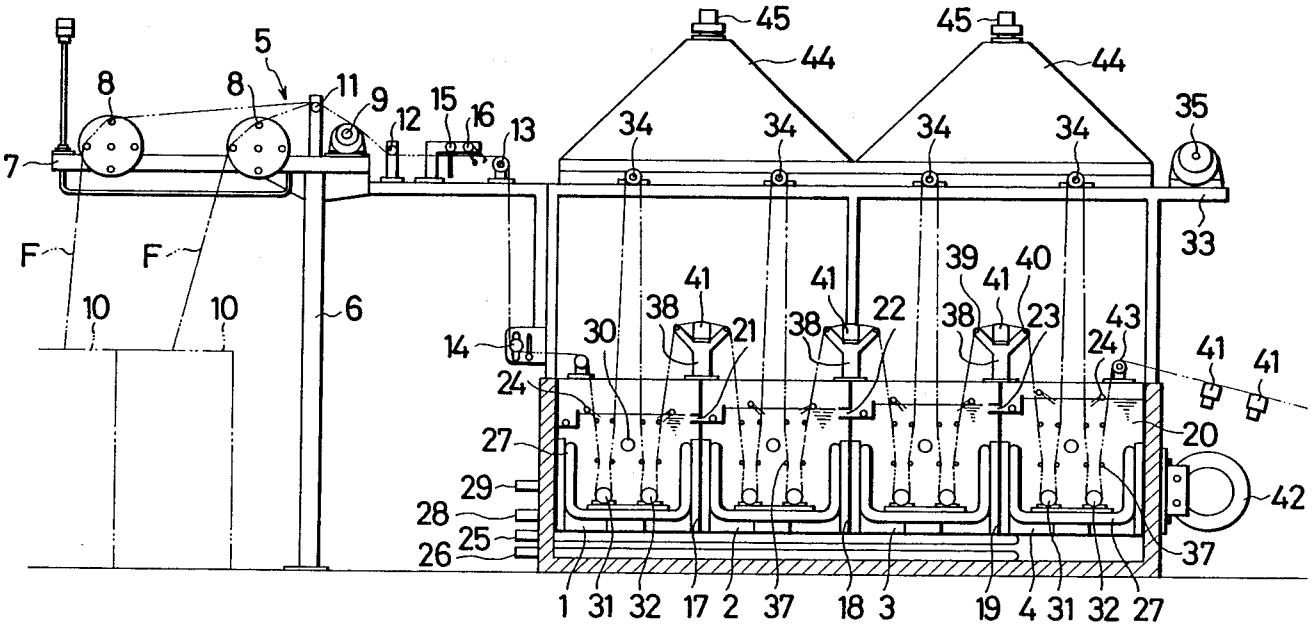
FIG. 1 is a longitudinal cross-sectional view of a tape washing apparatus embodying the present invention.
Figure 2:
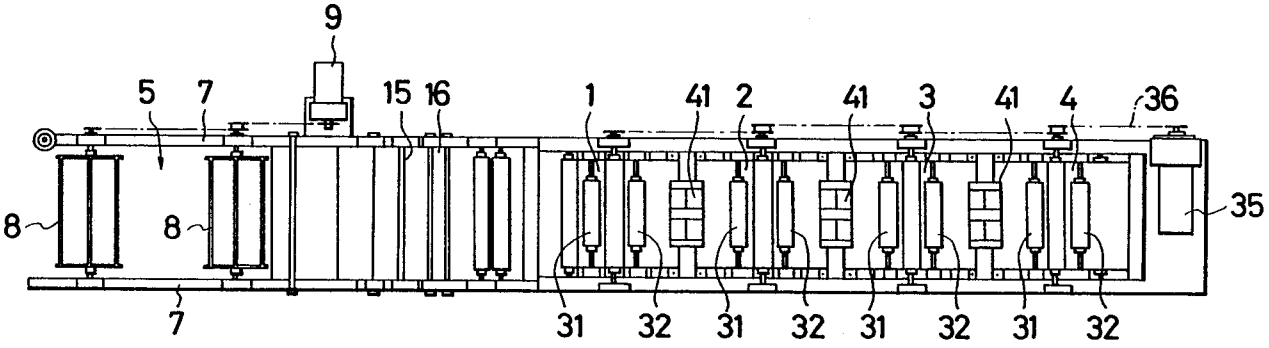
FIG. 2 is a plan view of FIG. 1.

FIGS. 1 and 2 show an apparatus for washing at least one elongated tape F, such as for touch-and-close or surface-type fasteners.

The apparatus generally comprises first, second third and fourth baths 1, 2, 3, 4 disposed in succesion each for containing hot water 20, and a feed unit 5 disposed adjacent to the first bath for feeding the tape F through the successive baths 1, 2, 3, 4 where the tape F is washed in a manner discribed below. The completely washed tape F is discharged out of the apparatus via the fourth bath 4 and is then supplied to a subsequent drying station (not shown).

The feed unit 5 includes a horizontal first support member 7 fixedly secured to a post 6, and a plurality of pin rollers 8 rotatably mounted on the first support member 7 and adapted to be driven by a first motor 9 for rotation in a direction opposite to the feeding direction of the tape F. Each of the pin rollers 8 is composed a plurality of pins mounted between a pair of circular disks at equal circumferential distances. Disposed under the feed unit 7 are a plurality of cans 10 each for containing the repsective tape F. The tape F from each of the cans 10 is wound on the respective pin roller 8 and is fed to the first bath 1 via a plurality of first guide rollers 11, 12, 13, 14 arranged between the feed unit 5 and the first bath 1.

A twist detector 15 is disposed between two of the first guide rollers 12, 13 for producing a feed-termination signal when a twisted portion of the tape F arrives at the twist detector 15. A non-suppply detector 16 also is disposed between the two first guide rollers 12, 13 immediately downstream of the twist detector 15 for producing a stop-demand signal when there is no supply of the tape F from the can 10; upon receipt of the stop-demand signal, the apparatus is rendered to be inoperative or stopped.

The first, second third and fourth baths 1, 2, 3, 4 are formed by dividing a single large tank by a plurality of partitions 17, 18, 19 and each of the baths 1, 2, 3, 4 is filled with hot water 20. Each of the partitions 17, 18, 19 has a through opening 21, 22, 23; the through opening 23 of the partition 19 is disposed at a highest position above the bottom of the tank, and the through opening 21 of the partition 17 is disposed at a lowerest position. The hot water 20 in the fourth bath 4 overflows into the third bath 3 via the through opening 23, while the hot water 20 in the third bath 3 overflows into the second bath 2 via the through opening 22. Likewise, the hot water 20 in the second bath 2 overflows into the first bath 1 via the through opening 21.

A pair of shower nozzles 24, 24 is disposed in each of the baths 1, 2, 3, 4 at a position slightly higher than the level of the hot water 20 in the respective bath 1, 2, 3, 4. In order to keep the level of the hot water 20 constant, the tank has a draining pipe 25 for discharging the overflown hot water, and a discharge pipe 26 for discharging all of the hot water 20 in the four baths 1, 2, 3, 4. Each of the baths 1, 2, 3, 4 is also provided with a steam pipe 27 for circulation therethrough of steam or vapor via a steam inlet 28 and a stem outlet 29. The temperature of the hot water 20 in each bath 1, 2, 3, 4 is kept constant by a temperature sensor 30 disposed in the respective bath 1, 2, 3, 4.

A pair of second guide rollers 31, 32 is mounted on the bottom of each bath 1, 2, 3, 4, and a driven roller 34 supported by a horizontal second support member 33 above the respective bath 1, 2, 3, 4 in vertical alignment with the center between the pair of the second guide rollers 31, 32. The driven roller 34 is operatively connected to a second motor 35 via an endless chain 36 for rotation in the direction of feeding the tape F. Thus the tape F from the first guide roller 14 extends about one of the second guide rollers 31 on the bottom of the first bath 1, then about the driven roller 34 on the second support member 33 above the first bath 1, and thereafter about the other second guide roller 32 on the bottom of the first bath 1. Similarly, the tape F from the first bath 1 extends about one of the second guide rollers 31 on the bottom of the second bath 2, then about the driven roller 34 on the second support member 33, and thereafter about the other guide roller 32 on the second bath 2. The tape F from the second bath 2 further extends through the third bath 3 and then through the fourth bath 4 in the like manner and finally to a subsequent processing station such as for drying. If the tape f is a touch-and-close or surface-type fastener tape, the tape F is wound on the driven roller 34 with only the element-free tape surface in contact with the periphery of the driven roller 34, thus preventing the fastener elements from any abrasive wear.

In each of the baths 1, 2, 3, 4, the tape F runs upwardly and downwardly in a meandering fashion as guided by a plurality of guide pins 37 which are mounted in each bath and assist to prevent the tape F from being contacted by itself.

When the tape F is transferred from one bath to the next bath, hot water contained in the tape f is removed by a hot-water removing unit. This removing unit includes a V-shaped arm 38 mounted on the top of the respective partition 17, 18, 19, a pair of third guide rollers 39, 40 rotatably supported on opposite distal ends of the V-shaped arm 38, and a centrally slitted suction nozzle 41 supported on the arm 38 between the two third guide rollers 39, 40. The suction nozzle 41 is operatively connected to a ring-shaped blower 42 for sucking hot water on and in the tape F while the latter runs over the top surface of the suction nozzle 41 as guided by the third guide rollers 39, 40.

A discharge roller 43 is mounted on the top of the final or fourth bath 4 for assisting in discharging the washed tape F out of the washing apparatus to the next processing station. In the path of the tape F from the washing apparatus to the next processing station, a plurality of additional suction nozzles 41 of the above described construction are disposed for assisting in removing hot water left in the tape F.

Supported on and over the second support member 33 are a pair of covers 44, 44 each carrying an exhaust fan 45 for discharging vapor rising from the baths 1, 2, 3, 4.

According to the present invention, partly because the elongated tape is fed through a succession of hot-water baths, and partly because the tape is brought upwardly out of the hot water and the downwardly into the hot water in each bath, the tape can be washed without being twisted or entangled and hence can be fed in an orderly fashion through the successive baths. Another advantage of the present invention is that since the tape is raised from the level of the hot water in the individual bath and is then returned into the hot water, a certain amount of frictional resistance is created between the tape and the hot water, and hot water on and in the raised tape flows downwardly into the bath along the tape, thus guaranteeing improved cleaning of the tape.

Although various minor modifications may be suggested by those versed in the art, it should be understood that I wish to embody within the scope of the patent granted hereon, all such embodiments as reasonably and properly come within the scope of my contribution to the art.

What is claimed is:

1. An apparatus for washing an elongated tape with hot water, comprising:

(a) a succession of hot-water baths;

(b) at least two guide rollers on and about which the tape is to be fed, said guide rollers being mounted in each of the baths;

(c) at least one driven roller on and about which the tape is to be fed, said driven roller being disposed above each of the baths in vertical alignment with the center between said guide rollers; and (d) a hot-water removing unit disposed between each adjacent pair of said baths for removing the hot water from the tape when the latter is transferred from one of said baths to the next bath in which said hot-water removing unit includes a V-shaped arm disposed above and between each adjacent pair of said baths a pair of guide rollers rotatably supported on opposite distal ends of said V-shaped arm, and a suction nozzle supported on said arm between said guide rollers for sucking the hot water from the tape while the latter is passing over a top surface of said suction nozzle.

2. A washing apparatus according to claim 1, further including at least one shower nozzle disposed in each of said baths at a position slightly higher than the level of the hot water in the respective bath for spraying the hot water over the tape.

3. A washing apparatus according to claim 1, further including a plurality of guide pins mounted in each of said baths for guiding the tape upwardly and downwardly in a meandering fashion.

4. A washing apparatus according to claim 1, in which said successive baths are separated one from the next by a plurality of partitions each having in its upper portion a through opening, the height of said through opening of each said bath gradually increasing from an upstream end one of said successive baths toward a downstream end one of said baths.

* * * * *